United States Patent [19]

Rogers et al.

[11] 4,288,007

[45] Sep. 8, 1981

[54] STRUCTURE FOR HOLDING A RESERVOIR IN AN INVERTED POSITION FOR GRAVITY DISPENSING OF A LIQUID

[75] Inventors: Dan C. Rogers; Joseph A. Maggio, both of Miami, Fla.

[73] Assignee: M.R.E. Enterprises, Inc., Miami Lakes, Fla.

[21] Appl. No.: 911,897

[22] Filed: Jun. 2, 1978

[51] Int. Cl.[3] ..... B67D 5/60

[52] U.S. Cl. ..... 222/66; 141/376; 222/131; 222/181; 222/481.5; 222/504; 248/311.3

[58] Field of Search ..... 222/63, 66, 129.1, 131, 222/180, 181, 183, 185, 478, 504, 481.5; 141/375, 376; 248/311.3

[56] References Cited

U.S. PATENT DOCUMENTS

| | | | |
|---|---|---|---|
| 2,669,941 | 2/1954 | Stafford | 222/66 X |
| 2,734,659 | 2/1956 | Smith | 222/185 X |
| 2,746,646 | 5/1956 | Hall | 222/181 X |
| 2,768,659 | 10/1956 | Kirkendall | 222/181 X |
| 3,033,422 | 5/1962 | Totten | 222/66 X |
| 3,211,330 | 10/1965 | Frankel | 222/481.5 X |
| 3,565,228 | 2/1971 | Young | 222/181 X |
| 3,847,303 | 11/1974 | Szendroi et al. | 222/66 |
| 4,121,741 | 10/1978 | Adamson | 222/181 |

FOREIGN PATENT DOCUMENTS

| | | | |
|---|---|---|---|
| 1135634 | 8/1962 | Fed. Rep. of Germany | 222/181 |

*Primary Examiner*—Robert J. Spar
*Assistant Examiner*—Fred A. Silverberg
*Attorney, Agent, or Firm*—Lowe, King, Price & Becker

[57] ABSTRACT

Plural liquid containing bottles of differing sizes are simultaneously held in a cabinet in an inverted position so that the liquid flows by gravity from an orifice at the top of each bottle. A tension spring controls the vertical position of a first, fixed bearing surface for the top of each bottle relative to a second bearing surface for the bottom of the bottle to facilitate insertion of different sized bottles between the surfaces. A valve is selectively opened to enable liquid to be dispensed by gravity from the bottle through a dispensing tube extending through a stopper in the orifice. A vent tube attached to the stopper has an open end exposed to the atmosphere above a liquid-air interface in the bottle to assure the flow of liquid to the valve. The second surface carries the stopper and is on a plate that is detachable from the remainder of the holding structure and is horizontally slidable toward and away from a door through which bottles are inserted into the cabinet.

28 Claims, 7 Drawing Figures

18
19
13
25
144
143
27
28
29
31
34
35
117
24
36
28
38
143
29
34
27
12
45
6
6
41
40
22
39
23
44
38
45
37
54
46
145
32
26
150
43
42
41
141
142
38
41
42
22
23
43
142
141
38

STRUCTURE FOR HOLDING A RESERVOIR IN AN INVERTED POSITION FOR GRAVITY DISPENSING OF A LIQUID

FIELD OF THE INVENTION

The present invention relates generally to apparatus for holding liquid reservoirs, and more particularly, to an apparatus for holding a liquid reservoir, such as a bottle, in an inverted position so that liquid can flow by gravity from the bottle to a dispensing station.

BACKGROUND OF THE INVENTION

There has been previously developed and marketed a structure for holding liquid reservoirs, such as liquor bottles or the like, in an inverted position, so that liquid flows from the bottles to a dispensing station in response to a valve being activated from a closed to an open position. The bottles are mounted in a cabinet, behind glass windows, so that a user or operator of the device can easily see what types and brands of liquor are available for dispensing. Extending through the orifice of each bottle is a stopper, through which a vent tube and a liquid dispensing tube extend. One end of the vent tube, below the orifice, communicates with the atmosphere outside of the bottle. The other end of the vent tube extends within the bottle above the liquid air interface so that atmospheric air pressure is exerted on the interface, to prevent formation of a low pressure air pocket inside of the bottle and assure dispensing of the liquid from the interior of the bottle. The dispensing tube is normally closed by an electromechanically actuated pinching mechanism, which when energized, enables liquid to flow by gravity to a glass on a rack.

The bottles are mounted in the cabinet so that the bottom of the bottle normally bears against the cabinet ceiling and the stopper bears against a horizontal holding plate that is vertically translatable relative to the cabinet ceiling. It is necessary to translate the stopper holding plate because different bottles are likely to have differing sizes. To translate the plate vertically, it is mounted on a bracket including a pair of bolt and wing nut assemblies that are vertically slidable in a pair of vertically extending slots on a sheet metal mounting on a rear wall of the cabinet. The bolts extend through apertures in the bracket so that as the brackets are raised and lowered, the plate is correspondingly varied in position.

Numerous problems have arisen in the prior art structure. Difficulties have been encountered in installing the bottles within the cabinet. Each time a bottle is to be installed, it is necessary to lower the stopper holding plate by turning the wing nuts. When a new bottle is placed in the cabinet, the wing nut position must be readjusted. If the new bottle has a different size from the bottle which was previously at the particular location in the cabinet, the correct wing nut and bolt position must be found. Holding the bottle in place, while the plate is adjusted and then adjusting the wing nut position has been found to be very difficult for one person to accomplish.

The vent tube arrangement has also caused problems when a new bottle is installed because liquid flows, i.e., fountains, from the vent tube unless it is closed. To this end, a small, removable rubber plug is inserted over the vent tube while the bottle is being inserted into the cabinet. Frequently, the bottle installer forgets to remove the plug, to prevent correct operation of the device. In addition, there is drying of liquid in the relatively small diameter dispensing tube leading from the stopper to the valve, necessitating replacement of the dispensing tube.

It is, accordingly, an object of the present invention to provide a new and improved structure for holding liquid reservoirs, particularly bottles, in an inverted position.

Another object of the invention is to provide a new and improved apparatus for enabling different sized bottles to be easily inserted in an inverted position in a cabinet from which the liquid is to be dispensed.

Another object of the invention is to provide a new and improved apparatus for enabling a supporting surface for a bottle held in an inverted position to be easily adjusted in vertical position relative to a second surface against which the bottom of the inverted bottle bears.

Another object of the invention is to provide a new and improved apparatus for holding liquid dispensing bottles in an inverted position so that liquid can be dispensed by gravity from the bottles through a valve, wherein the bottles can easily be installed into the cabinet.

Another object of the invention is to provide a new and improved atmospheric venting structure for a gravity liquid dispenser.

A further object of the invention is to provide a new and improved atmospheric venting structure for the contents of a reservoir from which liquid is dispensed by gravity, wherein the necessity to close off the venting structure during installation is obviated.

BRIEF DESCRIPTION OF THE INVENTION

In accordance with one aspect of the invention, an improved structure for enabling liquid to be dispensed by gravity from an orifice at the top of a bottle held in an inverted position on a bottle carriage assembly includes a stationary, horizontally extending first surface against which the bottom bottle surface bears and a second horizontally extending surface against which a portion of the bottle removed from the bottom surface of the bottle bears. A spring controls the vertical position of the second surface relative to the first surface and maintains the bottom bottle surface and removed bottle portion in bearing relation against the first and second surfaces. A valve responds to liquid at the orifice and is selectively opened and closed to enable liquid to be dispensed by gravity from the bottle. A vent extends through the orifice to apply sufficient pressure to the liquid in the bottle to cause the liquid to flow by gravity to the valve.

The spring preferably is a tension spring heaving one end fixedly mounted between the two bearing surfaces. A second end of the tension spring, below the one fixed end, is connected to a member that is translatable with the second surface, to urge the second surface upwardly towards the first surface. A stopper extending through the bottle orifice bears against the second surface, which in turn is the upper face of a plate forming a part of a stopper mounting member. The stopper mounting member is cantilevered on the bottle carriage assembly, which is mounted on a vertical rear surface in a cabinet for the bottles. The vertical surface is opposite from a door through which the bottles are inserted onto and removed from the bottle carriage asesmbly. The first end of the spring is positioned closer to the vertical surface than the second end of the spring, which is connected to the member at a region intermediate the vertical surface and a region against which the bottle bears vertically on the second surface, so that the tension spring exerts a torque on the bottle carriage assembly to facilitate horizontal adjustment of the assembly, as well as insertion and removal of the bottle.

Insertion and removal of the bottle through the door and into the cabinet are also facilitated by arranging the stopper mounting member so it is horizontally slidable toward and away from the vertical cabinet surface. The member is mounted on a pair of parallel rails so that the member can be detached from the remainder of the bottle carriage assembly. The member includes a pair of spaced ears that downwardly depend from opposite edges of the plate and are arranged so that they can be grasped by digits (preferably the thumb and forefinger) of one hand of a bottle installer. The ears slide on the rails in a horizontal direction, to facilitate bottle installation, once the bottle has been placed in an inverted position, with the stopper in situ in the bottle orifice.

Installation is further facilitated by obviating the need for a vent plug. This result is achieved by arranging the vent so that it includes a conduit leading into the bottle through the stopper from outside of the bottle. In one embodiment, the conduit has an open end above the interface level so that the liquid can not fountain out of the conduit and the need for a plug in the vent is obviated.

A further feature of the invention relates to sensing and signalling when all of the liquid in the bottle has been exhausted. This is an important feature if the cabinet is installed in a hotel room, so that bottle installers, at a remote location, can be apprised of the need to install additional bottles in the cabinet. In one preferred embodiment, a liquid sensor is responsive to the electric conductivity of fluid at the valve.

It is, therefore, still another object of the invention to provide a new and improved apparatus for signalling that there is no more liquid in a liquid reservoir.

The above and still further objects, features and advantages of the present invention will become apparent upon consideration of the following detailed description of several specific embodiments thereof, especially when taken in conjunction with the accompanying drawing.

DETAILED DESCRIPTION OF THE DRAWING

Figure 1:
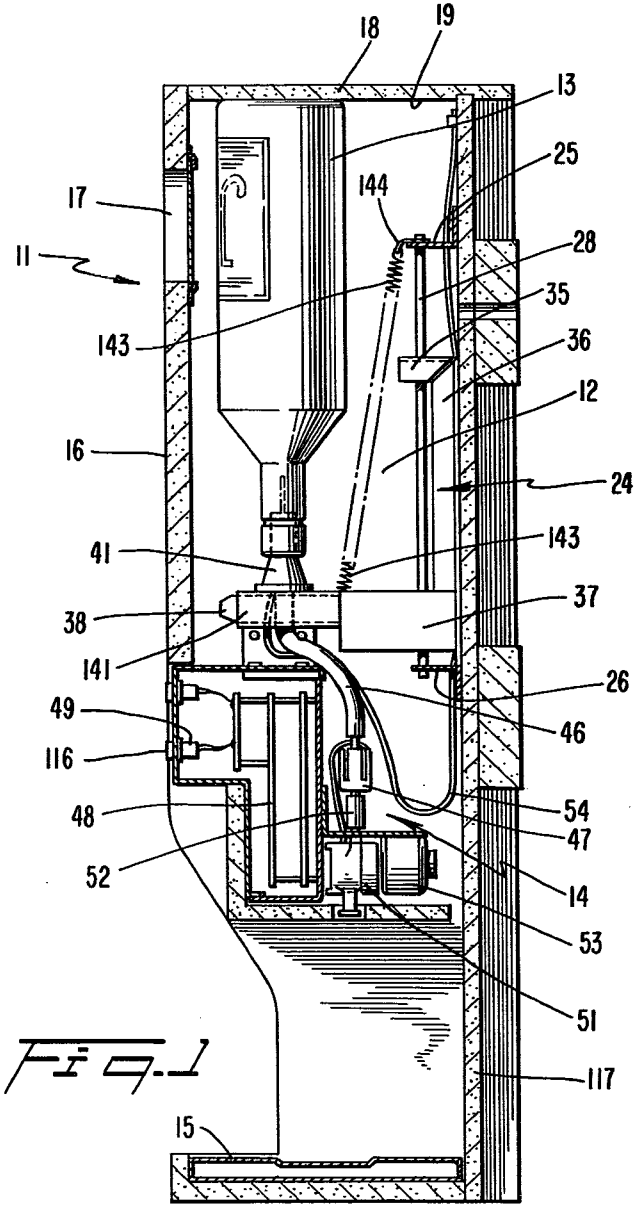
FIG. 1 is a side sectional view of a cabinet holding a bottle in accordance with a preferred embodiment of the invention.
Figure 2:
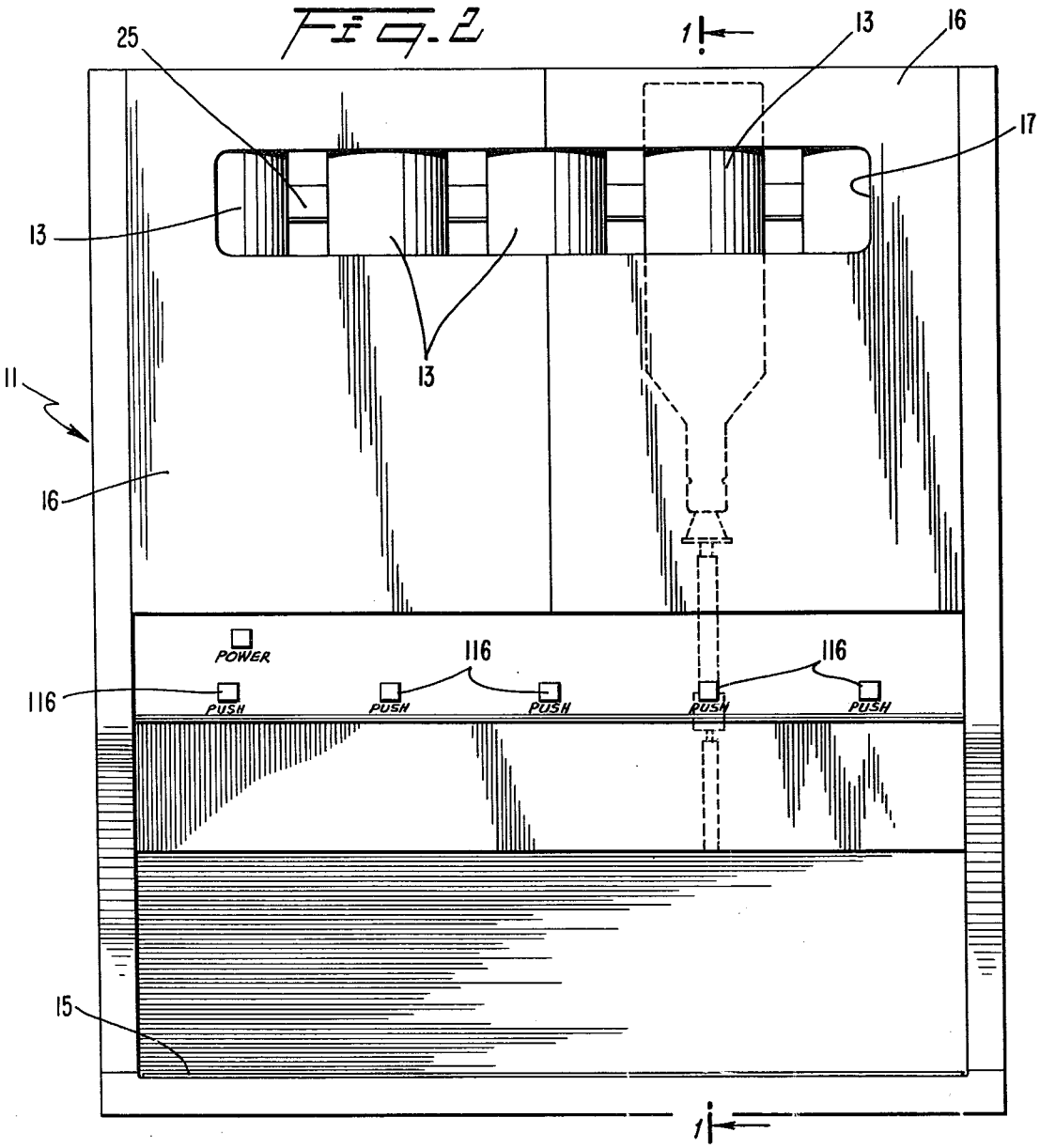
FIG. 2 is a front view, partly broken away, of the cabinet illustrated in FIG. 1.
Figure 3:
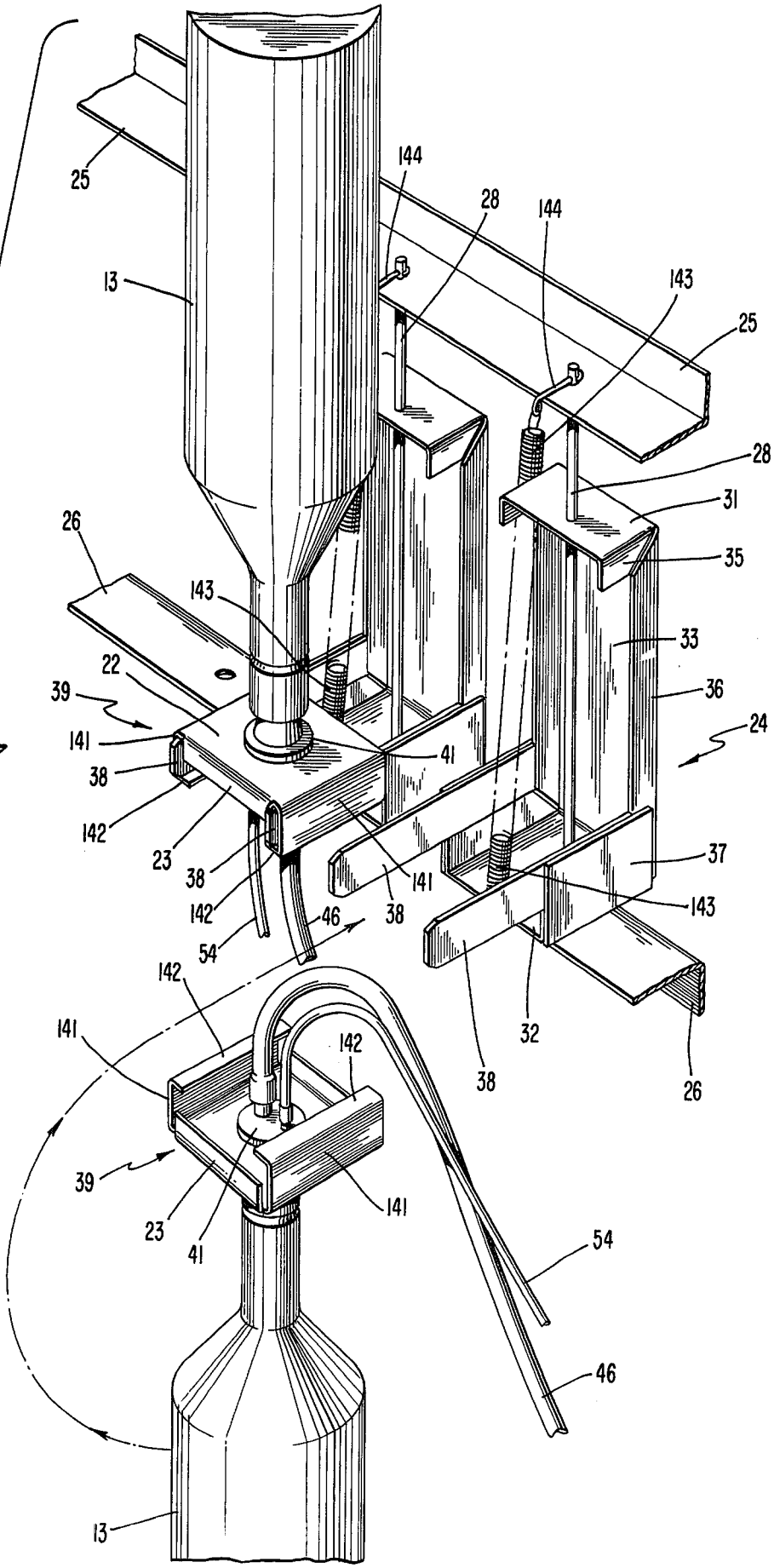
FIG. 3 is an exploded, perspective view of the bottle holding assembly included in the cabinet illustrated in FIGS. 1 and 2.
Figures 4, 6, 7:
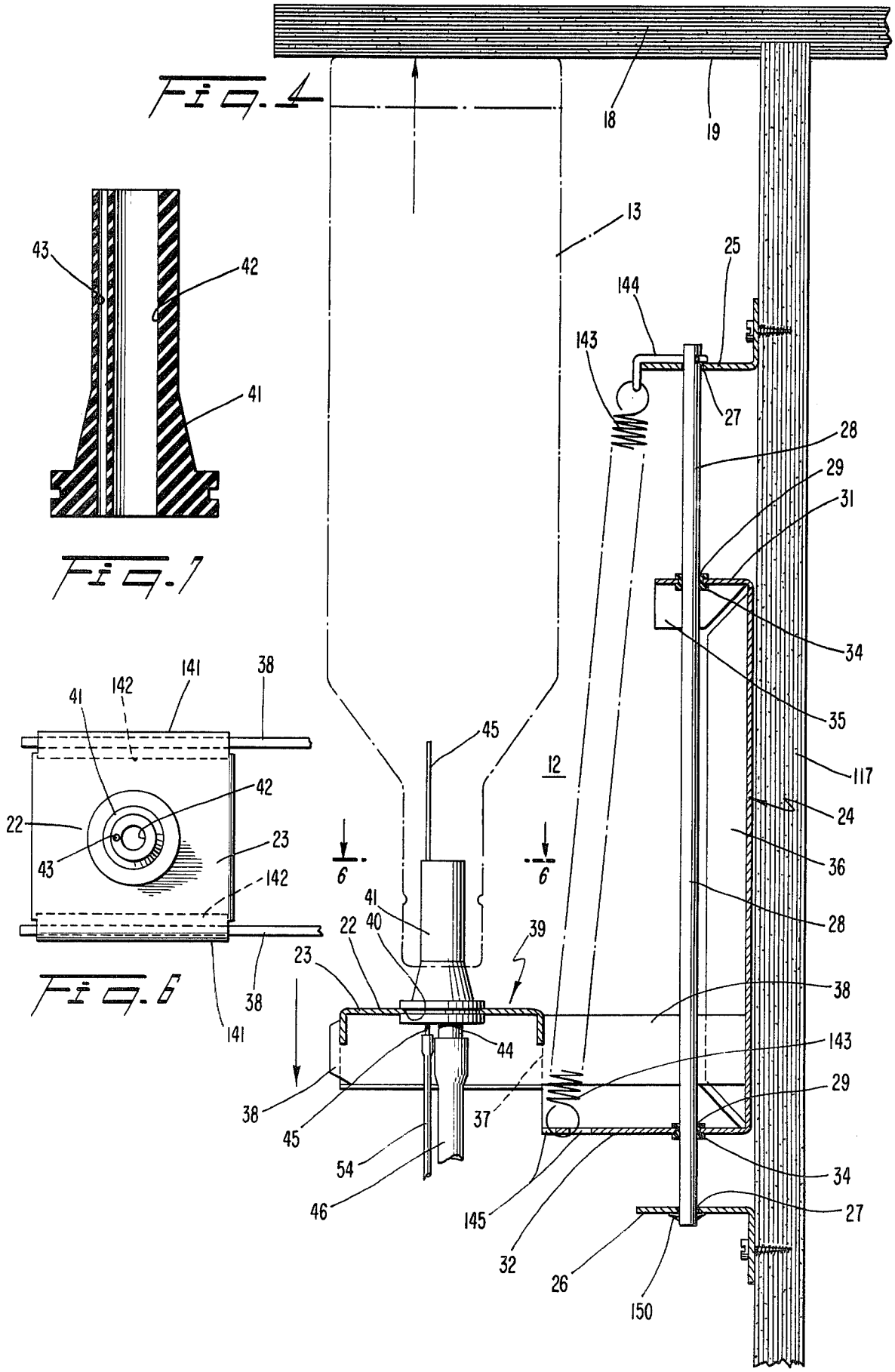
FIG. 4 is a side view of the bottle holding assembly illustrated in FIG. 3.
FIG. 6 is a view taken through the lines 6—6 of FIG. 4.
FIG. 7 is a view of a stopper.
Figure 5:
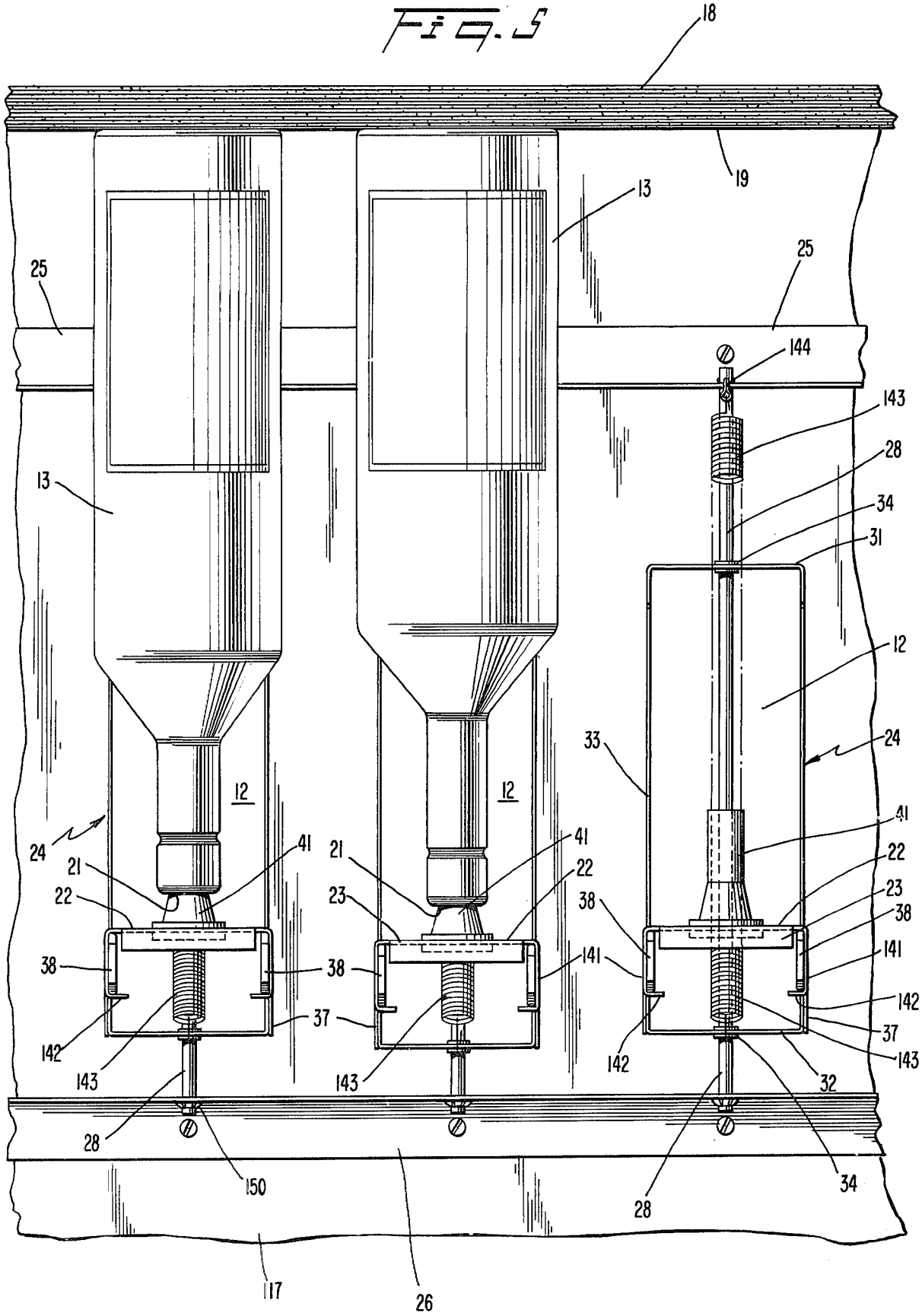
FIG. 5 is a front view of a portion of the cabinet with a door of the cabinet removed and showing two bottles in situ and one of the mechanisms without a bottle in situ.

Reference is now made to the drawing wherein cabinet 11, formed generally as a right paralelepiped, includes five side-by-side bottle carriage assemblies 12, each of which may hold a separate bottle 13 in an inverted position. In one particular application, bottles 13 are liquor bottles and cabinet 11 is fixedly mounted on a wall of a hotel room, bar or wheeled cabinet. Associated with each bottle assembly 12 is a dispensing control mechanism 14, which enables liquid in bottles 13 to flow selectively by gravity to glasses (not shown) that are placed on tray 15, in proximity to the bottom of cabinet 11. Mechanism 14 is actuated by an operator, desirous of causing liquid to be dispensed from bottle 13 to the glass, depressing one of push-buttons 116, one of which is associated with each of the bottle carriage assemblies 12.

Cabinet 11 includes a vertically extending door 16 that is normally maintained in a locked condition by a suitable tab structure (not shown) which forms no part of the present invention. Door 16 includes an elongated window 17, which enables a label on each of bottles 13 to be viewed so that the operator can easily select the appropriate push-button 16. Cabinet 11 also includes a vertically extending rear wall 117, having suitable bores which enable cabinet 11 to be mounted on the wall of the place where cabinet 11 is located. Cabinet 11 also includes an upper plate 18 having a lower face 19 that defines the cabinet ceiling. The bottom of bottle 13, in the inverted position, bears against ceiling 19, while the top of the bottle, where dispensing orifice 21 is located, bears against horizontally extending, upper face 22 of plate 23 that is a part of bottle assembly 12.

Because different bottles that are inserted into cabinet 11 are likely to have differing heights, and to facilitate insertion and removal of the bottles into cabinet 11 through door 16, it is necessary for surface 22 to have a variable vertical position relative to horizontally extending ceiling surface 19. To this end, bottle holder assembly 12 includes bracket 24 which is vertically translatable between vertically displaced angle irons 25 and 26 that are fixedly mounted on back wall 17. Horizontally extending segments of angle irons 25 and 26 include pairs of aligned bores 27 through which vertically extending shaft 28 extends. Shaft 28 also extends through aligned bores 29 in horizontally extending flanges 31 and 32 of bracket 24. Flanges 31 and 32 are connected to each other by a vertically extending body portion 33 of bracket 24. Nylon bushings 34 are positioned in bores 29 to enable bracket 24 to slide easily in the vertical direction, on shaft 28. Strengthening flanges 35 and 36 are provided on opposite edges of flanges 31 and body portion 33, respectively, while panels 37 extend upwardly from flange 32 and outwardly from flange 36, to which the panels are fixedly secured by welding. To enable plate 23 to be easily slid relative to the remainder of body assembly 12, parallel, horizontally extending rails 38 are cantilevered to and project outwardly from panels 37.

Plate 23 forms the upper, horizontally extending portion of stopper mounting member 39, that is a part of bottle holder assembly 12. Mounting member 39 includes a pair of ears 141 that depend downwardly from plate 23. Flanges 142 extend inwardly towards each other from ears 141 so that stopper mounting member 39 can be captured on rails 38 and horizontally translated on the rails. Stopper mounting member 39 can be completely removed from rails 38, so that a horizontally extending surface of stopper 41, that extends through orifice 21 of bottle 13, can be inserted into circular aperture 40 of plate 23 and bear against the plate upper face 22.

The position of bottle holder assembly 12 relative to angle irons 25 and 26 is controlled by tension spring 143 that extends outwardly and downwardly from an intersection between shaft 27 and the horizontal surface of angle iron 25 to bottom flange 32 of assembly 12. To this end, the upper end of spring 143 is held in situ by cotter pin 144 that rests on the upper face of the horizontal portion of angle iron 25 and extends through a horizontally extending bore in shaft 28. The lower end of tension spring 143 is captured in holes 145, on flange 32, just behind the vertical, abutting edges of mounting member 39 and panel 37. Cotter pin 144 and spring steel retaining washer 150 in aperture 27 of angle iron 26 fixedly mount shaft 28 between the angle irons.

To dispense liquid by gravity from bottle 12, stopper 41 includes a pair of vertically extending bores 42 and 43 that respectively receive sleeves or tubes 44 and 45, respectively employed for dispensing and venting purposes. Dispensing sleeve 44 is co-terminus with the upper face of stopper 41 inside of bottle 13, so that the maximum amount of liquid can be dispensed from the bottle. The lower end of sleeve 44 is connected to flexible tube 46 that terminates at dispensing mechanism 14.

Dispensing mechanism 14 comprises a cylindrical fluid detector 47 including an interior bore having an upper end connected to the outlet of tube 46. Detector 47, a commercially available unit responsive to the electrical conductivity of the fluid supplied to it by tube 46, derives a bi-level signal indicative of the conductivity of fluid in its bore being greater than or less than a predetermined amplitude. In response to the conductivity of the fluid sensed by detector 47 being less than the predetermined amplitude, the signal level indicates that there is liquid in detector 47; in response to no liquid being in the bore of detector 47, the electrical conductivity sensed by the detector increases greatly and the signal level indicates that the liquid in bottle 13 has been exhausted. The bi-level signal derived from sensor 47 is applied to electronic circuit module 48, which derives an output signal to control lamp 49 that is positioned behind button 116. In addition, electronic module 48 supplies a signal to a remote location to indicate whether or not there is liquid in bottle 13.

Detector 47 includes a fluid outlet, located below its inlet; the outlet of detector 47 is connected to the fluid inlet of valve 51 by tube 52. Valve 51 includes an electromechanical actuator 53 responsive to signals derived from electronic module 48, in turn responsive to depression of button 116. Normally, actuator 53 closes valve 51 so that no liquid flows from tube 52 to the outlet of valve 51, which is located below the valve inlet. In response to a suitable signal being derived from electronic module 48, to indicate that liquid is to be dispensed from bottle 13, actuator 53 is energized for a predetermined interval to open valve 51 and enable a predetermined amount of liquid to flow to a glass on tray 15.

Atmospheric pressure is applied to the liquid-air interface within bottle 13 to prevent formation of a low pressure pocket in bottle 13 to assure that liquid flows from the bottle through valve 51 when actuator 53 is energized by the output of module 48. The atmospheric pressure is applied by one end of vent tube 45 that extends through stopper 41 to the liquid in the bottle. The other end of vent tube 45, extending from the lower face of stopper 41, is connected to a flexible plastic tube 54, having an open end which is secured in situ on wall 17 at a level above the liquid level in bottle 13. Flexible tube 54 has sufficient length, between its connection point to sleeve 45 and the point to which it is secured to wall 17, to enable stopper 41 to be inserted into bottle 13 outside of cabinet 16 while the tube is connected to the stopper as well as to enable the stopper and bottle to be placed together in aperture 40 on plate 23. Because the open end of tube 54 is above the liquid-air interface within bottle 13, there is no possibility of liquid running from the bottle as it is installed into cabinet 11, provided the air-liquid interface is kept below the open end of tube 54. It has been found by experimentation that tube 45 should extend within bottle 13 about two inches above the face of stopper 41 within the bottle. Air pressure between the interior and exterior of bottle 13 is equalized because air bubbles rise from the end of tube 45 within the bottle to the liquid-air interface in the bottle. By arranging the end of tube 45 about two inches above stopper 41, these rising bubbles are sufficiently removed from bore 42 and the end of tube 44 in the bore so that the bubbles do not mix with the dispensed liquid to reduce the volume of liquid dispensed each time button 116 is depressed. It is also possible to eliminate vent tube 54 and to connect a check valve to the end of tube 45 outside of bottle 13. Such a check valve would respond to the difference in pressure between the atmosphere and the fluid at the upper end of tube 45 and would allow outside air to flow into tube 45 and bottle 13 when the bottle fluid pressure is less than atmospheric.

To install an open, filled bottle 13 into cabinet 16, stopper 41 containing vent tube 45 and a dispensing tube 44, which remains connected to detector 47, is pushed into the bottle orifice while the bottle is outside of cabinet 11. Stopper 41 is fixedly mounted on stopper mount 39 which has been previously removed from the remainder of bottle holder assembly 12. Because of the length and flexibility of tube 54, stopper 41 can easily be inserted into the orifice of bottle 13, while the bottle is outside of cabinet 11 in an upright position. Bottle 13 is then turned to an inverted, upside-down position. Bottle 13, with stopper mount 39, stopper 41 and tubes 46 and 54 in place, is then put into cabinet 11 by inserting it through door 16. As a bottle installer grasps stopper mount 39 with one hand, he grasps bracket 24 with the other hand. As stopper mount 39 is slid onto rails 38, bottle 13 assumes a more vertical position and ultimately the bottom of the bottle engages ceiling 19. Then, stopper mount 39 is pushed all the way back on rails 38, so that the vertical edges of ears 141 and panels 37 are in abutting relation. Door 16 is then closed and locked, and the cabinet is ready to be operated. The reverse operations are performed when it is desired to remove empty bottle 13 from cabinet 11.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A structure for enabling liquid to be dispensed by gravity from orifices at the tops of a plurality of bottles adapted to be inserted simultaneously in situ into the structure, differing simultaneously inserted bottles being susceptible of having differing heights along longitudinal axes thereof between a bottom surface thereof and the top, comprising means for simultaneously holding the plurality of bottles in an inverted position so that the orifices of the bottles are below the bottom surfaces thereof and the longitudinal axes of the bottles are substantially vertical, said holding means including a stationary, horizontally extending first surface against which the bottom surfaces of all the bottles simultaneously bear, a separate horizontally extending second surface for each bottle, each second surface being arranged so a portion of the bottle removed from the bottom surface of the bottle bears against it, each of said second surfaces being vertically translatable relative to the first surface to accomodate bottles of differing heights, spring means for separately controlling the vertical position of each of the second surfaces and for maintaining the bottom surface and the removed bottle portion of each of the bottles in a bearing relation against the first surface and the separate second surfaces, valve means in fluid flow relationship with liquid at the orifice of each bottle for selectively enabling liquid to be dispensed by gravity from each of the bottles, and vent means for each of the bottles extending through the orifice of each of the bottles for applying sufficient pressure to an air-liquid interface in each bottle to cause the liquid in each bottle to flow by gravity to the valve means of each bottle.

2. The structure of claim 1 wherein the spring means for each bottle comprises a tension spring having one end fixedly mounted between the first surface and the second surface for each bottle and another end below the one end, said another end being connected to a member carrying the second surface to urge the second surface upwardly toward the first surface.

3. The structure of claim 2 further including a vertically extending door, the bottles while on the holding means being located behind the door, the door being positioned so that the bottles are inserted onto and removed from the holding means through the door, each of the second surfaces being on a separate member, each of the separate members being cantilevered from a vertical surface opposite from the door, said one end of each spring being positioned closer to the vertical surface than the another end of the spring, the another end of each spring being connected to the member corresponding to it at a region intermediate the vertical surface and a region against which the corresponding bottle bears vertically on the corresponding second surface.

4. The structure of claim 3 further including a separate stopper in the orifice of each bottle, the vent means and valve means of each bottle being connected to the corresponding bottle interior via conduits extending through the corresponding stopper, each stopper having a horizontal surface bearing against the region on the corresponding second surface.

5. The apparatus of claim 2 wherein for each bottle the second surface is fixedly mounted to a bracket having a pair of vertically displaced horizontally disposed flanges having aligned bores, a single shaft extending through said bores so that the bracket can slide up and down on the shaft.

6. The structure of claim 1 further including separate sensing means responsive to the presence and absence of liquid at each valve means for deriving a signal to indicate the presence and absence of liquid at each valve means.

7. The structure of claim 6 wherein each of the sensing means is responsive to the electric conductivity of fluid at each of the valve means.

8. The structure of claim 1 wherein for each bottle the vent means includes: a first conduit portion extending into the bottle, and a second conduit portion extending outside of the bottle, said second conduit portion having an open end above the interface, said conduit portions being connected in fluid flow relation to each other through the orifice.

9. The structure of claim 8 wherein for each bottle the first conduit portion extends approximately two inches into the bottle so air from the open end of the second conduit portion bubbles into the liquid in the bottle through the first conduit portion.

10. The structure of claim 1 wherein the vent means for each bottle comprises a second conduit having a portion in the stopper, the second conduit having an opening in the reservoir adjacent the orifice and removed from the bottle bottom surface, the second conduit including means for causing bubbles to rise through the liquid from the opening of the second conduit to the interface to equalize the pressure between the interior of the reservoir, above the interface, to atmospheric pressure outside of the reservoir.

11. The structure of claim 10 wherein the opening of the second conduit in the reservoir extends into the reservoir away from an opening of the first conduit into the reservoir by a sufficient amount to prevent mixing of the bubbles with liquid flowing through the first conduit and the valve when the valve is opened.

12. The structure of claim 10 or 11 wherein the second conduit has an opening exterior to the reservoir at a height above the interface to form the means for causing air bubbles and the opening of the second conduit in the reservoir is substantially below the opening exterior to the reservoir.

13. A structure for enabling liquid to be dispensed by gravity from an orifice at the top of a bottle adapted to be inserted in situ into the structure, differing bottles being susceptible of having differing heights along longitudinal axes thereof between a bottom surface thereof and the top, comprising means for holding the bottle in an inverted position so that the orifice of the bottle is below the bottom surface and the longitudinal axis of the bottle is substantially vertical, said holding means including a stationary, horizontally extending first surface against which the bottom bottle surface bears, a horizontally extending second surface against which a portion of the bottle removed from the bottom surface of the bottle bears, said second surface being vertically translatable relative to the first surface, spring means of controlling the vertical position of the second surface and for maintaining the bottom surface and removed bottle portion in a bearing relation against the first and second surfaces, valve means in fluid flow relationship with liquid at the orifice for selectively enabling liquid to be dispensed by gravity from the bottle, and vent means extending through the orifice for applying sufficient pressure to an air-liquid interface in the bottle to cause the liquid to flow by gravity to the valve means, the spring means comprising a tension spring having one end fixedly mounted between the first and second surfaces and another end below the one end, said another end being connected to a member carrying the second surface to urge the second surface upwardly toward the first surface, a vertically extending door, the bottle while on the holding means being located behind the door, the door being positioned so that the bottle is inserted onto and removed from the holding means through the door, the second surface being on a member cantilevered from a vertical surface opposite from the door, the one end of the spring being positioned closer to the vertical surface than the another end of the spring, the another end of the spring being connected to the member at a region intermediate the vertical surface and a region against which the bottle bears vertically on the second surface, a stopper in the orifice, the vent means and valve means being connected to the bottle interior via conduits extending through the stopper, the stopper having a horizontal surface bearing against the region on the second surface, the second surface being on a plate, said plate being a separable part of the bottle holding means, said plate being horizontally slidable away from the vertical surface and toward the door so that the plate can be detached from the remainder of the holding means and the stopper with the bottle thereon in the inverted position can be placed on the plate while the plate is detached.

14. The structure of claim 13 wherein the bottle holding means includes a pair of spaced rails fixedly mounted to extend horizontally away from the vertical surface toward the door, a pair of spaced ears downwardly depending from opposite edges of the plate for holding the plate in situ on the rails and for enabling the plate to slide on the rails.

15. The structure of claim 14 wherein the ears are arranged so that they can be grasped by digits of one hand of an operator installing the bottle through the door.

16. The structure of claim 15 wherein a stopper extends through the orifice, a first conduit in the stopper connecting the liquid in the bottle to the valve means, the vent means including a second conduit having a portion in the stopper as well as further and additional portions respectively inside and outside of the bottle, the additional portion having an open end above the level of liquid in the bottle.

17. Apparatus for dispensing liquid by gravity from an orifice in a reservoir comprising means for holding the reservoir in an inverted position so the orifice is at the bottom of the reservoir, a vertically extending door, said holding means including a fixed portion and a slidable member, said slidable member including a plate having a horizontally extending surface against which the reservoir downwardly bears, the reservoir, while on the holding means, being located behind the door, the door and holding means being arranged so that the reservoir is inserted on and removed from the holding means through the door, a stopper in the orifice, the stopper having a horizontal surface bearing against the horizontal surface of the plate, a conduit extending through the stopper to be in fluid flow relation with liquid in the reservoir, valve means connected to the conduit for selectively enabling liquid to be dispensed by gravity from the reservoir, vent means extending through the stopper for applying sufficient pressure to the liquid in the reservoir to cause the liquid to flow by gravity to the valve means, the plate being horizontally slidable away from and toward the door so that the plate can be detached from the fixed portion of the holding means and the stopper with the bottle thereon in the inverted position can be placed on the plate while the plate is detached.

18. The apparatus of claim 17 wherein the holding means includes a pair of spaced rails fixedly mounted to extend horizontally toward the door, a pair of spaced ears downwardly depending from opposite edges of the plate for holding the plate in situ and enabling the plate to slide on the rails.

19. The apparatus of claim 18 wherein the ears are arranged so that they can be grasped by digits of one hand of an operator installing the bottle through the door.

20. The apparatus of claim 17 further including sensing means responsive to the presence and absence of liquid at the valve means for deriving a signal to indicate the presence and absence of liquid at the valve means.

21. The apparatus of claim 17 further including a first conduit in the stopper connecting the liquid in the bottle to the valve means, the vent means including a second conduit having a portion in the stopper as well as further and an additional portion outside of the bottle, the additional portion having an open end above the level of liquid in the bottle.

22. The apparatus of claim 21 wherein the portion of the second conduit in the stopper extends into the bottle approximately two inches from a face of the stopper inside of the bottle.

23. The apparatus of claim 17 wherein the vent means for each bottle comprises a second conduit having a portion in the stopper, the second conduit having an opening in the reservoir adjacent the orifice and removed from the bottle bottom surface, the second conduit including means for causing bubbles to rise through the liquid from the opening of the second conduit to the interface to equalize the pressure between the interior of the reservoir, above the interface, to atmospheric pressure outside of the reservoir.

24. The apparatus of claim 23 wherein the opening of the second conduit in the reservoir extends into the reservoir away from an opening of the first conduit into the reservoir by a sufficient amount to prevent mixing of the bubbles with liquid flowing through the first conduit and the valve when the valve is opened.

25. The apparatus of claim 23 or 24 wherein the second conduit has an opening exterior to the reservoir at a height above the interface to form the means for causing air bubbles and the opening of the second conduit in the reservoir is substantially below the opening exterior to the reservoir.

26. A structure for enabling liquid to be dispensed by gravity from an orifice at the top of a bottle adapted to be inserted in situ into the structure comprising means for holding the bottle in an inverted position so that the orifice of the bottle is below a bottom surface thereof and the longitudinal axis of the bottle is substantially vertical, said holding means including a horizontally extending first surface against which the bottom bottle surface bears, a plate including a horizontally extending second surface against which a portion of the bottle removed from the bottom surface of the bottle bears, said second surface being vertically translatable relative to the first surface, tension spring means for controlling the vertical position of the second surface and for maintaining the bottom surface and removed bottle portion in a bearing relation against the first and second surfaces, said spring having one end fixedly mounted between the first and second surfaces and another end below the one end, said another end being connected to a member carrying the second surface to urge the second surface upwardly toward the first surface, valve means in fluid flow relation with liquid at the orifice for selectively enabling liquid to be dispensed by gravity from the bottle, the second surface being on a member cantilevered from a vertical surface, said one end of the spring being positioned closer to the vertical surface than the another end of the spring, the another end of the spring being connected to the member at a region intermediate the vertical surface and a region against which the bottle bears vertically on the second surface, a stopper in the orifice, the valve means being connected to the bottle interior via a conduit extending through the stopper, the stopper having a horizontal surface bearing against the region on the second surface, said plate being a separable part of the bottle holding means, said plate being horizontally slidable away from the vertical surface so that the plate can be detached from the remainder of the holding means and the stopper with the bottle thereon in the inverted position can be placed on the plate while the plate is detached.

27. The structure of claim 26 wherein the bottle holding means includes a pair of spaced rails fixedly mounted to extend horizontally away from the vertical surface toward the door, a pair of spaced ears downwardly depending from opposite edges of the plate for holding the plate in situ on the rails and for enabling the plate to slide on the rails.

28. The structure of claim 27 wherein the ears are arranged so that they can be grasped by digits of one hand of an operator installing the bottle.

* * * * *